United States Patent [19]

Evans

[11] 4,205,796

[45] Jun. 3, 1980

[54] VIBRATING RECLAIMER OF FOUNDRY MOLD MATERIAL

[75] Inventor: Robley W. Evans, Jeffersonville, Ind.

[73] Assignee: Rexnord Inc., Milwaukee, Wis.

[21] Appl. No.: 883,433

[22] Filed: Mar. 3, 1978

[51] Int. Cl.[2] ..... B02C 13/13

[52] U.S. Cl. ..... 241/152 A; 241/DIG. 10; 241/190

[58] Field of Search ..... 241/24, 29, 75, 79, 241/83, 82, 88.4, 152 R, 152 A, 190, DIG. 10

[56] References Cited

U.S. PATENT DOCUMENTS

| | | | |
|---|---|---|---|
| 2,095,385 | 10/1937 | Heisserman | 241/DIG. 10 |
| 2,331,102 | 10/1943 | Bird | 241/152 X |
| 3,542,299 | 11/1970 | Sholl | 241/24 |
| 3,829,029 | 8/1979 | Carpenter et al. | 241/DIG. 10 X |
| 3,863,847 | 2/1975 | Day et al. | 241/79 X |

*Primary Examiner*—Roy Lake
*Assistant Examiner*—Eugene F. Desmond

[57] ABSTRACT

An apparatus for reclaiming material primarily used in the fabrication of foundry molds is provided in which the sand in the form of large chunks of mold is introduced into a vibrating conveyor and carried initially to a rotary hammer assembly. The chunks are chopped into finer pieces which fall back into the conveyor and are moved into a vibrating drum assembly which causes the pieces to self-abrade into particles. When the particles reach a predetermined size, they leave the drum through a perforated gate means and fall back into the conveyor which carries the particles to a vibrating screen. Particles passing through the screen are then removed for further processing.

11 Claims, 5 Drawing Figures

16
40a
40
42
38
14
54
52
12
18
19
22
24
32
20
19
19
13
10
11
48
50

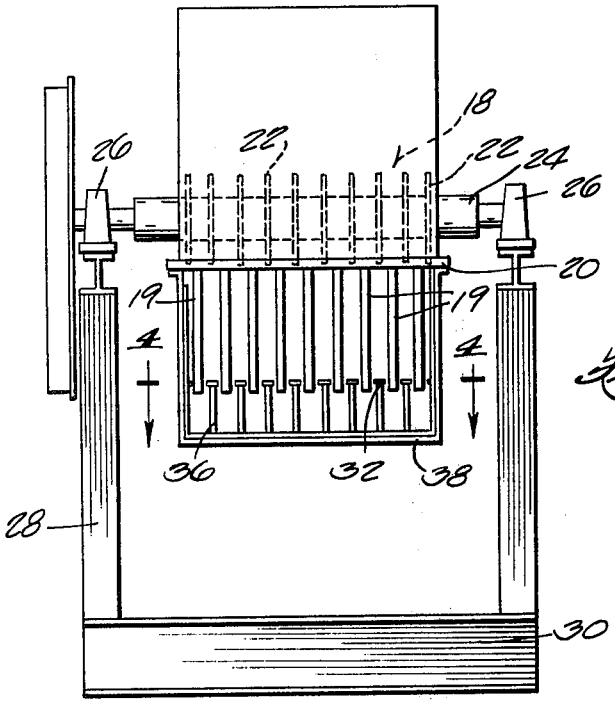
Fig. 2.
Fig. 3
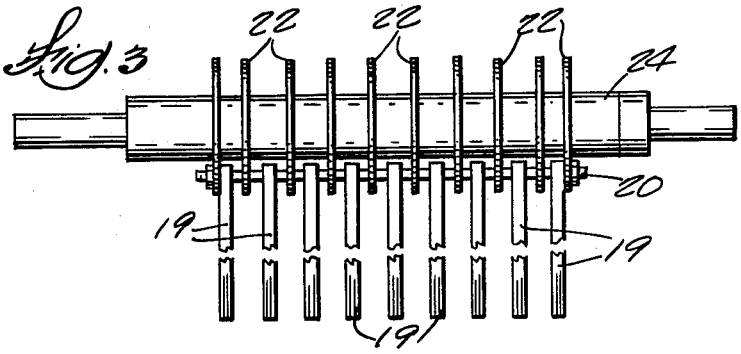
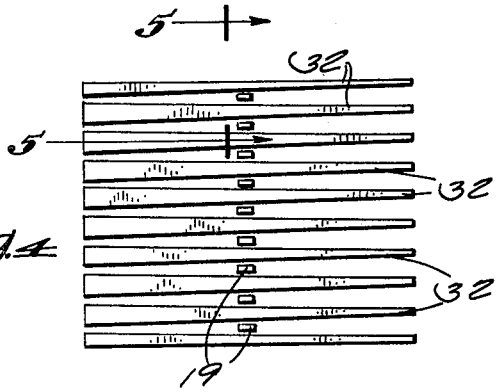
Fig. 4
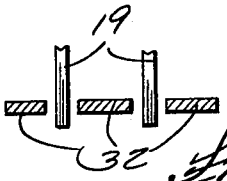
Fig. 5

VIBRATING RECLAIMER OF FOUNDRY MOLD MATERIAL

BACKGROUND OF THE INVENTION

Foundry operations use molds in which to make various structures from molten metallic materials. Molds are made from many materials such as plastics, metals, sand and clay with binders like benenite. Sand, however, generally constitutes the predominant material used by the foundry industry. The art of fabricating molds is extremely old, and until recent years, comprised the traditional steps of fashioning the mold pattern from a mixture of sand and moist clay and baking at least the mold core at elevated temperatures to harden the mold. Frequently, the molds need not only large quantities of sand to provide sufficient strength to hold their shape during the pouring process, but also require a backup with steel forms known as flasks.

The foundry industry has recently developed a new mold fabrication process which utilizes granular sand and a binder. Briefly, the binder and sand are mixed, fashioned into a desired pattern, and thereafter the binder chemically reacts and hardens to form the mixture into a mold. Other than eliminating the need to bake the mold, another readily observable advantage is the increased strength of the mold relative to conventional molds. Less sand per unit volume of the mold is also needed. The use of flasks is virtually eliminated.

Reclaimation of molding sand following use of the mold has always been a matter of concern and, because of economics, necessary. The cost of replacing or disposing of the sand is high. With the older or conventional molds, the technique employed was simple. It was expedient only to screen out the trash and break the mold. Ring breakers on a vibrating screen were often employed.

The later techniques using sand and chemical binders for mold fabrication, however, complicated the reclaiming procedure. The binder is very hard and surrounds virtually every grain of sand and must be removed if the sand is to be reclaimed. As stated above, the economics of replacement and disposal of the sand dictate the need for reclaimation. Presently, there are two techniques which have been employed: a mechanical abrading technique of the sand to remove the binder and a thermal reclaimation. The latter has often been termed too expensive as it requires heating of the sand to temperatures in excess of 700° Celsius with subsequent cooling.

Mechanical abrading may be accomplished, for example, by feeding the sand into a high speed centrifugal wheel and impacting on a surface. This shot-blast technique has been considered successful. There are other techniques such as for example, U.S. Pat. Nos. 3,793,780 and 4,025,419 both of which describe a vibratory tumbling apparatus which through material abrasion of foundry lumps causes a wearing down of the molds into particulate form. Specifically, both inventions through the geometry of the hopper, positioning of vibratory motors, and selective energization of the motors provides controlled directional movement to the lumps and/or sand. In one mode of operation, the lumps are retained in a desired area of the vibrating hopper. A second mode provides movement of the particulate material out of the hopper toward the reclaiming stage.

A disadvantage of the systems typified by the above is the small "through-put". The need to continually change the direction of flow provides an interval in which the throw of the hopper prevents the material to be reclaimed from exiting the hopper. Additionally, many of the lumps encountered are on the order of 45 to 60 centimeter cubes which would require an inordinate amount of time to wear down. Finally, when the hopper becomes filled with tramp material, it is necessary to reverse the direction of the various motors to cause the tramp material to move out of the hopper in the direction from which it was initially introduced.

It is therefore a paramount object of the present invention to provide unitary apparatus which in a continuous operation breaks up large mold lumps into smaller pieces which self-abrade under vibratory action into reclaimable particulate material. Still another important object is the elimination of periodic reversal for removal of tramp material.

BRIEF SUMMARY OF THE INVENTION

Vibratory action is a successful and economical means for accomplishing the final breakdown of molds into particulate material, due to self-abrasion. The economics of accomplishing breakdown solely by self-abrasion is questionable, however. It has been noted that not only must all tramp metal such as chill rods, flasks, etc., be removed prior to what is termed "shake-out", but the sand itself must be reduced to a maximum size of one centimeter or less. The present invention provides a unitary device which initially breaks-up the large mold material into smaller pieces or chucks which feed into a simple vibrating drum for both self-abrasion and abrasion by tumbling against tramp metallic material and finally out of the drum into a region in which shake-out occurs. Specifically, a vibrating conveyor means conveys the mold particles on the order of sixty (60) centimeters in diameter or more into a rotary hammer section which crushes the material so that it can pass back to the conveyor means. The rotary hammers are pivotably mounted and have a length from pivot of a dimension such that large pieces of tramp metallic material are permitted to egress therefrom. The crushed material is carried into a vibrating drum section where the material is caused to flow and self-abrade continuously in a circular motion over a perforated gate. The tramp material also assists in abrading the crushed material. Particles of a predetermined size or smaller penetrate the perforations and again pass back to the conveying means. Larger particles circulate back again and are continually abraded until the appropriately sized particles are obtained. From this point, the particles are carried into a separating section where appropriately sized particles are separated for further processing.

BRIEF DESCRIPTION OF THE DRAWINGS

FIG. 2 is an end view of the rotary hammer assembly with portions removed for clarity.

FIG. 3 is an enlarged view of the rotary hammers and connections thereof to the rotating axle.

FIG. 4 is an enlarged view of the grizzly bars taken along line 4—4 of FIG. 2.

FIG. 5 is a view taken along line 5—5 of FIG. 4 showing the penetration of the hammers between adjacent grizzly bars.

Figure 1:
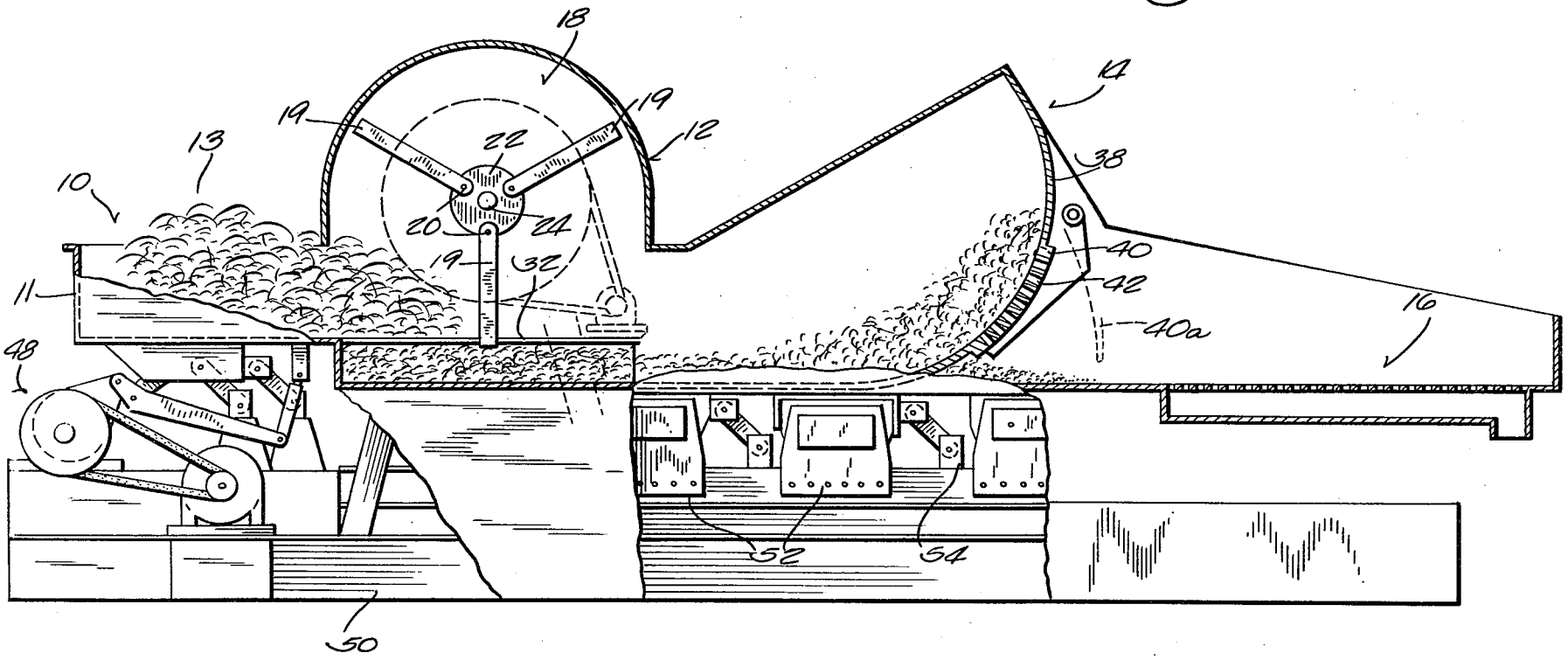
FIG. 1 is a side view showing a vibratory sand reclaiming apparatus in accordance with the present invention.

DETAILED DESCRIPTION OF THE PREFERRED EMBODIMENT:

Referring now to the schematic of FIG. 1, it is seen that the apparatus of the present invention comprises four major areas or sections. First depicted is a feed section 10 which comprises the front end of a vibrating conveyor 11 into which chunks of sand molds on the order of 60 centimeters in diameter may be fed. Located adjacent and down stream of the feed section is a rotary hammer section 12 for breaking the chunks of sand molds into smaller pieces which are then fed by the conveyor into the confined volume of a vibrating drum section 14. Within this section, the material is vibrated, self-abrades into grain-size particles, and ultimately passes to a separation stage section 16 in which over sized particles are separated from the grain-size particles which filter down through separation stage 16.

Feed of material 13 into feed section 10 of conveyor 11 can be accomplished manually or through the use of any automatic means such as another conveyor. For purposes of this description, however, it is not essential to depict the mode by which feeding is accomplished.

Mounted above conveyor 11 and adjacent the feed section is rotary hammer assembly 18. As best seen in FIG. 2, assembly 18 comprises a plurality of hammers 19 pivotably mounted on a rod 20 secured to a plurality of plates 22 which in turn are coaxially mounted about and keyed to an axle 24. Axle 24 is journaled at each end thereof into a bearing assembly 26 supported by upright frames 28 fixed at the lower end to a base 30.

A plurality of grizzly bars 32 forming a surface over which the material passes are positioned co-planar with the front portion of bottom wall 34 of conveyor 11 which forms part of feed section 10. Conveyor 11 is stepped down beneath bars 32 which extend longitudinally above and parallel to bottom wall 34. Each bar 32 is supported by an upright plate 36 secured to a base 38 which is independent of and isolated from vibrating conveyor 11. Bars 32 are additionally spaced sufficiently far apart to permit the ends of hammers 19 to pass between adjacent bars 32. FIG. 5 clearly depicts the penetration of hammers 19 between bars 32. Each bar 32 is tapered in the downstream direction to provide a maximum clearance between bars of about ten centimeters. The dimensions of length and width, however, are a matter of choice.

In operation, material 13 is moved across the surface defined by bars 32. The impact of hammers 19 chops the material into a size sufficiently small to pass between bars 32 and fall onto conveyor 11. The material is then moved out of section 18 for further processing.

A driving means such as motor 38 (depicted in dashed lines) is used to drive hammers 19 in a counter clockwise direction to complement movement of material 13 by conveyor 11. Ordinarily, centrifugal force keeps hammers 19 extended radially outward from axle 24. When material such as tramp metal is encountered, hammers 19 will yield and pivot about rod 22 thereby avoiding damage to rotary hammer assembly 18.

While hammer mills having rotating hammers which are pivotable are known in the prior art, they are designed primarily to reduce the material introduced to small size. The hammer arms are consequently made very short in length and the ends thereof ordinarily do not pass between adjacent grizzly bars of a surface beneath the rotary hammer assembly. This should be contrasted to the rotary device in the present invention in which the hammer arms are specifically designed to break up the material while simultaneously permitting the entry into the hopper section of large tramp metallic material. It has been found that arms considerably longer than those found in the prior art are desireable. For example, it has been found desireable to use hammers at least forty (40) centimeters in length, preferably fifty (50) centimeters. Measured from center of rotation to the ends thereof, the preferred length is about sixty eight (68) centimeters. Such dimensions have been found to provide tramp material which is sufficiently large to assist in the reduction of foundry molds when in the vibrating drum section 14 to appropriate size for reclamation.

Vibrating drum section 14 may be an integral portion of conveyor 11 as illustrated in FIG. 1. The drum section 14 has a sloping curved wall 38, a portion of which is formed by a perforated hinged gate 40 which is biased into a closed position. The open position of gate 40 is illustrated by dashed lines. The throw of vibrating conveyor 11 is such that the material is thrust up along sloping wall 38 over the perforations 42 in gate 40. Particles of material too large to pass through the perforations 42 tumble back into the mainstream at a point intermediate the entrance of the drum and gate 40. The flow as seen in FIG. 1 is counter clockwise.

The material continually self-abrades until particles are formed which are sufficently small to pass through perforations 42 which are on the order of 0.6 centimeters in diameter. Particles passing through perforations 42 fall back onto conveyor 11 for further movement into separating stage section 16. Stage 16 includes a vibrating screen 46 having a mesh size dimensioned to retain oversized particulate material. Screen 46 is depicted in FIG. 1 as an extension of the bed of conveyor 11 and vibrates with the same frequency and throw. Oversized material passes over screen 46 while the desired material filters down through the screen and then is further processed in an air separator and the like.

Periodically, the hinged gate 40 may be opened and the collected tramp material may then move through opening and into conveyor 11. The tramp material generally metallic in nature may then be accumulated at the other end of screen 46.

The means for vibrating the conveyor 11, drum section 12, and separating section 14 may be any conventional vibrator mechanism such as end drive vibrator 48 beneath feed section 10. Similarly the mounting conveyor 11 itself to a stationary base 50 may be accomplished through a variety of different spring systems. It has, for example, been found convenient to employ a plurality of shear springs 52 and connecting links 54 as shown in FIG. 1. A preferred frequency of vibration is about 500 hertz with a stroke on the order of 2.5 centimeters. This stroke and frequency have been found appropriate for fast break-up and attrition of the mold into sand particles of the desired size.

Various alterations, modifications and changes will undoubtedly come to the mind of the artisan skilled in the arts having read this disclosure. Such changes, however, are intended to be within the scope of the invention as defined by the appended claims.

I claim:

1. An apparatus for the breaking and disintergrating of foundry molds into reclaimable particulate material comprising (a) vibrating conveying means for conveying materials to be broken and disintegrated including a feed section adapted to initially receive the material;

(b) means for vibrating said conveying means at a predetermined frequency and stroke;

(c) material breaking means for receiving material carried thereto by said conveying means and breaking the material into smaller pieces, said conveying means having a second section positioned adjacent said breaking means for collecting and removing broken pieces of material; and (d) a disintegrating means including a vibrating drum means positioned down stream from said material breaking means for receiving said broken pieces of material which self-abrades into particles due to the vibration of said drum means, said drum means having separating means for selectively restraining particles larger than a predetermined size from egress therethrough, said conveying means having a third section positioned adjacent said separating means for collecting and removing particles of material passing through said separating means.

2. The apparatus of claim 1 further including a screen means for receiving a bed of particles from said conveying means and separating particles of a predetermined size from the bed.

3. The apparatus of claim 1 in which said conveying means, said disintegrating means, and said screen means are connected and vibrated at a predetermined frequency and throw by said vibrating means.

4. The apparatus of claim 1 in which said material breaking means comprises a rotary hammer assembly having a plurality of hammers for impacting against said material.

5. The apparatus of claim 4 in which said material breaking means has a plurality of grizzly bars extending coplanar with the bottom of said conveying means in said feed section.

6. The apparatus of claim 5 in which said conveying means is a vibrating conveyor with the second section thereof positioned beneath said grizzly bars.

7. The apparatus of claim 6 including said separating means comprises a vibrating screen deck having perforations of sufficient size to permit egress of particles of a predetermined size from the bed.

8. The apparatus of claim 1 including a means for vibrating said drum means with a throw such that the material forms a bed which continuously moves across said separating means and circulates back into the bed at a point intermediate the entrance of broken material into said drum means and said separating means.

9. The apparatus of claim 8 in which said separating means comprises a perforated member pivotably mounted to said drum and covering an opening therein for movement between open and closed positions, the perforations being of a predetermined dimension to restrain material greater than the predetermined dimension from egress therethrough.

10. An apparatus for breaking and disintegrating foundry molds into reclaimable particulate material comprising (a) a conveyor capable of being vibrated for conveying materials to be broken and disintegrated, said conveyor including a feed section adapted to initially receive the material;

(b) a rotary hammer assembly having a plurality of hammers pivotably mounted for circular movement about a common axis of rotation and a plurality of elements mounted in a common plane beneath the axis of rotation of said hammers, said elements being positioned sufficiently apart from one another to permit penetration between adjacent elements of the ends of said hammers when fully extended in the downward direction;

(c) a drum capable of being vibrated and positioned adjacent said rotary hammer assembly for receiving broken pieces of material from said assembly and causing said broken pieces of material to abrade into particulate material, said drum having a perforated gate mounted thereon capable of movement between open and closed positions for passing particulate material and retaining tramp material when closed, said conveyor positioned to receive particulate material and tramp material from said drum;

(d) a screen deck capable of being vibrated for receiving a bed of particulate and tramp material from said drum and separating particles of a predetermined size or less from said bed; and (e) a means for vibrating said conveyor, drum, and screen at a predetermined stroke and frequency.

11. The apparatus of claim 10 in which the hammers of said rotary assembly are at least 40 centimeters in length.

* * * * *